United States Patent [19]

Shioi et al.

[11] Patent Number: 4,533,930

[45] Date of Patent: Aug. 6, 1985

[54] RECORDING MATERIALS

[75] Inventors: Shunshuke Shioi, Daito; Yasuo Takekawa, Neyagawa; Makoto Miyake, Ashiya, all of Japan

[73] Assignee: Kanzaki Paper Manufacturing Company, Ltd., Tokyo, Japan

[21] Appl. No.: 410,811

[22] Filed: Aug. 23, 1982

[30] Foreign Application Priority Data

Aug. 31, 1981 [JP] Japan ..... 56-137291

[51] Int. Cl.[3] ..... B41M 5/18; B41M 5/22

[52] U.S. Cl. ..... 346/211; 346/216; 346/225; 427/150; 427/151

[58] Field of Search ..... 282/27.5; 427/150, 151; 428/329, 411, 488, 537, 913, 914; 346/210, 211, 216, 225

[56] References Cited

U.S. PATENT DOCUMENTS

| | | | |
|---|---|---|---|
| 1,950,982 | 3/1934 | Gookin et al. | 282/27.5 |
| 2,299,693 | 10/1942 | Green | 428/320.4 |
| 3,912,831 | 10/1975 | Kan et al. | 427/145 |

*Primary Examiner*—Bruce H. Hess

*Attorney, Agent, or Firm*—Larson and Taylor

[57] ABSTRACT

This invention relates to recording materials comprising:

(a) an organic phosphorus-iron compound having a bond of $PO^-$ and/or $PS^-$ with $Fe^{+++}$ in the molecule and (b) a ligand compound capable of reacting with the organic phosphorus-iron compound to form a complex.

4 Claims, No Drawings

RECORDING MATERIALS

This invention relates to recording materials and more particularly to recording materials producing images due to a complex formed from a metal compound and a liqand compound. The term "recording materials" is used herein to mean materials which are employed to prepare recording sheets.

In recent years, pressure sensitive manifold papers, heat sensitive recording papers and electrothermal recording papers are widely used as recording sheets comprising an electron donating chromogenic material (hereinafter referred to as "color former") such as crystal violet lactone, benzoyl-leucomethyleneblue, etc. and an electron accepting reactant material (hereinafter referred to as "color acceptor") such as activated clay, phenol resin, polyvalent metal salt of aromatic carboxylic acid, bisphenol A, etc. However, these recording sheets have found no application in important documents because such recording sheets suffer serious drawbacks that images formed thereon are poor in light resistance although sharp and variable in tone with a lapse of time and are made obscure or effaced by use of a line marker, cellophane tape or the like.

There are known various kinds of recording sheets which utilize the color forming reaction due to a complex formed from a metal compound and a ligand compound (for example, Japanese Examined Patent Publication No. 5617/1970 and No. 38206/1970). The recording sheets utilizing the formation of a complex are capable of producing images high in light resistance, hardly variable in tone with a lapse of time and unlikely to be effaced by a line marker, cellophane tape or the like. But such recording sheets mostly fail to form images with a high image intensity, and even recording sheets achieving a high image intensity often involve the use of a ligand compound or metal compound which is deeply colored.

The materials for preparing a complex include trivalent iron compounds. These compounds, however, have thick brown color themselves. Therefore, when used to produce sharp images, the compound act to color strongly the recording sheet. In other words, the compound exhibits poor color forming ability when employed in such small amount as to eliminate the objection of coloring the sheet.

It is an object of this invention to provide an iron-chelate type recording material which is substantially free from coloration by the starting compounds and which is capable of producing images having a high resistance to light and little or no variation in tone with a lapse of time and being unlikely to be effaced by a line marker, cellophane tape or the like.

It is another object of the invention to provide an iron-chelate type recording material which can produce, within a short period of time, sharp images high in light resistance, hardly variable in tone with a lapse of and scarcely effaceable by a line marker, cellophane tape or the like.

These objects and other features of this invention will become apparent from the following description.

These objects of the invention can be accomplished by using as a metal compound an organic phosphorus-iron compound having a bond of $PO^-$ and/or $PS^-$ with $Fe^{+++}$ in the molecule (hereinafter reffered to as "PF compound") and as a ligand compound a compound reacting with the PF compound to form a complex.

This invention provides recording materials comprising:

(a) a PF compound and (b) a ligand compound which reacts with the PF compound to form a complex.

Examples of the PF compounds are those one component of which is at least one of organic phosphorus compounds represented by the following formulae (II) to (XIX) in which the hydrogen of PO-H or PS-H is substituted with $Fe^{+++}$.

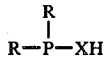
(II)

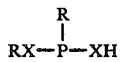
(III)

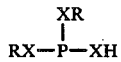
(IV)

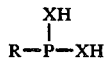
(V)

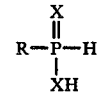
(VI)

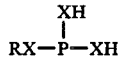
(VII)

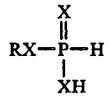
(VIII)

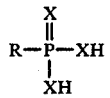
(IX)

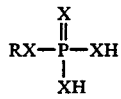
(X)

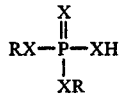
(XI)

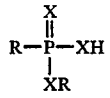
(XII)

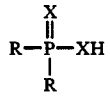
(XIII)

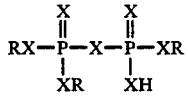
(XIV)

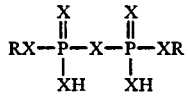
(XV)

-continued

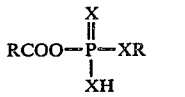
(XVI)

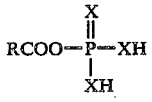
(XVII)

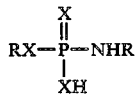
(XVIII)

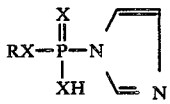
(XIX)

In the above formulae, X is the same or different and represents oxygen atom or sulfur atom and R is the same or different and represents alkyl group or aryl group. The alkyl and/or aryl group(s) may form a 5-membered or 6-membered ring with phosphorus atom or with oxygen and/or sulfur atom(s) between phosphorus atom and the groups. Illustrated below are examples of 5-membered or 6-membered rings having oxygen atoms between phosphorus atom and the groups.

(a)

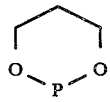

(b)

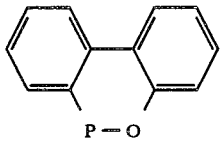

(c)

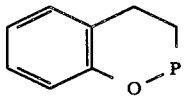

(d)

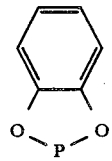

(e)

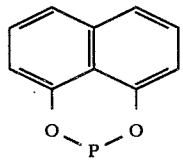

The ring (d) is a 5-membered ring consisting of one phenyl group, two oxygen atoms and one phosphorus atom. The rings (a), (b), (c) and (e) are 6-membered rings formed of one or two oxygen atoms, one phosphorus atom and one or two alkyl or aryl groups.

With this invention, useful organic phosphorus compounds include a homopolymer formed from a monomer having a bond of PO-H and/or PS-H, a copolymer formed from such monomer and another monomer, and an oligomer thereof. Examples of useful monomer are p-vinylphenyl phosphonic acid and p-vinylphenyl phosphate.

The alkyl groups represented by R include a saturated or unsaturated alkyl group with or without a substituent which alkyl may be any of straight-chain or branched-chain alkyl and cycloalkyl groups. Preferred alkyl groups are those having 1 to 22 carbon atoms except the carbon atoms in the substituent. Examples of the alkyl groups are methyl, ethyl, n-propyl, i-propyl, n-butyl, s-butyl, t-butyl, n-amyl, i-amyl, n-hexyl, n-octyl, n-decyl, n-dodecyl, n-tetradecyl, n-heptadecyl, n-octadecyl, decenyl, dodecenyl, tetradecenyl, heptadecenyl, octadecenyl, decynyl, octadecynyl, cyclohexyl, etc. Among these alkyl groups, more preferred are those having 4 to 20 carbon atoms except the carbon atoms contained in the substituent, and most preferred are saturated alkyl groups having 8 to 20 carbon atoms except the carbon atoms in the substituent. The aryl groups represented by R include those substituted or unsubstituted and are preferably those having 6 to 14 carbon atoms except the carbon atoms in the substituent. Exemplary of such aryl groups are phenyl, naphthyl, anthryl, etc. among which most preferable to use are substituted or unsubstituted phenyl or naphthyl.

Examples of the substituents for the alkyl groups, aryl groups and these groups forming the 5-membered or 6-membered rings, all represented by R, are chlorine, bromine, fluorine and like halogen atoms; cyano group; hydroxyl group; carboxyl group; amino group; sulfo group; methyl, ethyl, n-propyl, i-propyl, n-butyl, t-butyl, n-hexyl, t-octyl, n-decyl, n-dodecyl, n-tetradecyl, n-heptadecyl, n-octadecyl, cyclohexyl, methoxyethoxyethyl, benzyl, α-methylbenzyl, anisyl and like substituted or unsubstituted straight-chain or branched-chain alkyl groups having 1 to 20 carbon atoms; phenyl, naphthyl, hydroxyphenyl and like substituted or unsubstituted aryl groups; methoxy, ethoxy, propoxy, butoxy, methoxyethoxy and like substituted or unsubstituted alkoxy groups; phenoxy, tolyloxy, naphthoxy, methoxyphenoxy and like substituted or unsubstituted aryloxyl groups; methoxycarbonyl, butoxycarbonyl, phenoxymethoxycarbonyl and like substituted or unsubstituted alkoxycarbonyl groups; phenoxycarbonyl, tolyloxycarbonyl, methoxyphenoxycarbonyl and like substituted or unsubstituted aryloxycarbonyl groups; formyl, acetyl, valeryl, stearoyl, benzoyl, toluoyl, naphthoyl, p-methoxybenzoyl and like substituted or unsubstituted acyl groups; acetamido, benzoylamino, methoxyacetamido and like substituted or unsubstituted acylamino groups; N-butylcarbamoyl, N,N-diethylcarbamoyl, N-(4-methoxy-n-butyl)carbamoyl and like substituted or unsubstituted carbamoyl groups; N-butylsulfamoyl, N,N-diethylsulfamoyl, N-dodecylsulfamoyl, N-(4-methoxy-n-butyl)sulfamoyl and like substituted or unsubstituted sulfamoyl groups; methylsulfonylamino, phenylsulfonylamino, methoxymethylsulfonylamino and like substituted or unsubstituted sulfonylamino groups; mesyl, tosyl, methoxymethanesulfonyl and like substituted or unsubstituted sulfonyl groups, etc. Among these substituents, more preferable to use are halogen, cyano, hydroxyl, carboxyl, amino, sulfo, substituted or unsubstituted straight-chain or branched-chain alkyl or cycloalkyl having 1 to 20 carbon atoms, substituted or unsubstituted aryl, substituted or unsubstituted alkoxy, substituted or unsubstituted aryloxy, substituted or unsubstituted alkoxycarbonyl, substituted or unsubstituted aryloxycarbonyl, substituted or unsubstituted acyl, and substituted or unsubstituted acylamino. Among them, most preferred are substituted or unsubstituted straight-chain or branched-chain alkyl or cycloalkyl having 1 to 20 carbon atoms and substituted or unsubstituted aryl.

Preferred examples of the groups represented by R in the formulae of the organic phosphorus compounds according to the present invention are alkyl group or aryl group (including phenyl, naphthyl and anthryl) unsubstituted or having the preferred substituent exemplified above, and containing 4 to 20 carbon atoms except the carbon atoms in the substituent and 4 to 40 carbon atoms including those in the substituent.

More preferable of the groups represented by R are alkyl group (other than those unsaturated) or aryl group (including phenyl and naphthyl) unsubstituted or having the most preferred substituent exemplified above, and containing 6 to 20 carbon atoms except those in the substituent and 6 to 30 carbon atoms including those in the substituent.

The recording materials of this invention have an important feature in utilizing the color forming reaction between the PF compound and the ligand compound. Two or more types of organic phosphorus compounds including those having the same or different formulae given hereinbefore are usable in mixture as the component of the PF compound.

It is commercially preferred to use as the component of the PF compound an organic phosphorus compound in which X is oxygen, because the compound is readily available.

The object of this invention can be accomplished by forming a complex from the PF compound and the ligand compound. The color forming properties, particularly those initially possessed, of the recording materials according to the invention are markedly improved by using a composite iron salt resulting from the reaction between $Fe^{+++}$ and at least one of the organic phosphorus compounds of the formulae (II) to (XIX) and at least one of acids represented by the formula $$R-\overset{\overset{\displaystyle X}{\|}}{C}-Y-H \qquad (I)$$

wherein R and X are as defined above and Y is oxygen or sulfur. The molar ratio of the acid of the formula (I) to the organic phosphorus compound contained in the composite iron salt is not particularly limited. However, with the acid used in excess, it is impossible to produce recording materials having an improved whiteness as contemplated. The acid is used in an amount of preferably up to 250 moles, more preferably 30 to 200 moles per 100 moles of the organic phosphorus compound. Preferable of the acids of the formula (I) are those in which the group represented by R is alkyl group or aryl group (including phenyl, naphthyl and anthryl) unsubstituted or having the more preferred substituent exemplified above and containing 4 to 20 carbon atoms except the carbon atoms in the substituent and 6 to 30 carbon atoms including the carbon atoms in the substituent. More preferred acids are those in which the group represented by R is alkyl group (other than those unsaturated) or aryl group (including phenyl and naphthyl) unsubstituted or having the most preferred substituent exemplified above and containing 6 to 20 carbon atoms except the carbon atoms in the substituent and 12 to 24 carbon atoms including the carbon atoms in the substituent. It is commercially preferred to use the acid of the formula (I) wherein X and Y are both oxygen, because such acids are readily available. Specific examples of the most preferred acids are stearic acid, benzoic acid, 4-tert-butyl-benzoic acid, 4-n-pentyl-benzoic acid, 4-n-octyl-benzoic acid, 1-naphthoic acid, etc.

With this invention, the processes for preparing the PF compound are not specifically limited. For example, the PF compound can be prepared by bringing an aqueous solution of alkali metal salt, preferably sodium salt, of the organic phosphorus compound into contact with an aqueous solution of ferric salt such as ferric chloride or ferric sulfate to precipitate a ferric salt of the organic phosphorus compound. Exemplary of the processes for preparing the composite iron salt is a process comprising bringing an aqueous solution containing an alkali metal salt of the organic phosphorus compound and an alkali metal salt, preferably sodium salt, of the acid (I) into contact with an aqueous solution of ferric salt to produce a precipitate. With this invention, an iron salt of the organic phosphorus compound or a composite iron salt of the organic phosphorus compound and carboxylic acid can be used singly or in mixture. In this invention, the PF compound and composite iron salt may be a mixture of two or more compounds.

Useful as the ligand compound serving as the other component for the complex is any suitable compound capable of reacting with the PF compound and/or a composite iron salt to form a complex exhibiting color forming properties. Examples of such compounds are di-n-butylammonium-di-n-butyldithiocarbamate, t-octylammonium-t-octyldithiocarbamate, stearyltrimethylammoniumethylenebisdithiocarbamate, dibenzothiazyldisulfide, toluene-3,4-dithiol, benzoylacetone, dibenzoylacetone, salicylic acid, 3,5-di(α-methylbenzyl)salicylic acid, hydroxynaphthoic acid, naphthoanilide, 2-hydroxy-1-naphthoaldehyde, tropolone, hinokitiol, methoxyhydroxyacetophenone, resorcin, t-butylcatechol, dihydroxybenzenesulfonic acid, gallic acid, ethyl gallate, propyl gallate, isoamyl gallate, octyl gallate, lauryl gallate, benzyl gallate, tannic acid, pyrogallol tannin, protocatechuic acid, ethyl protocatechuate, pyrogallol-4-carboxylic acid, alizarin, diphenylcarbazide, 8-hydroxyquinoline, dichloro-8-hydroxyquinoline, dibromo-8-hydroxyquinoline, chlorobromo-8-hydroxyquinoline, methyl-8-hydroxyquinoline, butyl-8-hydroxyquinoline, lauryl-8-hydroxyquinoline, methylenebis(8-hydroxyquinoline), salicylaldoxime, anthranilic acid, quinolinecarboxylic acid, nitrosonaphthol, 2-mercaptoimidazoline, diphenylthiocarbazone, 6-ethoxy-2,2,4-trimethyl-1,2-dihydroquinoline, 6-phenyl-2,2,4-trimethyl-1,2-dihydroquinoline, 6-decyl-2,2,4-trimethyl-1,2-dihydroquinoline, 2-imidazoline, phenyl-α-naphthylamine, phenyl-β-naphthylamine, zinc butyl xanthate, zinc salicylate, zinc 3,5-di(α-methylbenzyl)-salicylate, etc. Preferable of these ligand compounds are gallic acid, ethyl gallate, propyl gallate, isoamyl gallate, octyl gallate, lauryl gallate, benzyl gallate, tannic acid, protocatechuic acid, ethyl protocatechuate, etc., because these compounds are readily available and colorless themselves.

The recording materials of this invention are usable for preparing pressure sensitive manifold papers, heat sensitive recording papers, electrothermal recording papers or the like. Further the recording materials of this invention can be employed in preparing recording sheets of the type in which one of the ligand compound and PF compound and/or composite iron salt is supplied in the form of ink to a support of the sheet coated with the other compound so that color marks are produced on the support.

Pressure sensitive manifold papers are recording sheets which utilize the principle that a color former such as crystal violet lactone, benzoyl leucomethyleneblue, etc. and a color acceptor interact to produce color marks. Such manifold papers comprise a top sheet, an under sheet and, if two or more copies are to be produced, one or more middle sheets. The top sheet (CB) has one surface of the support coated with color former-containing microcapsules prepared by any suitable process such as coacervation process, in-situ polymerization process and interfacial polymerization process. The under sheet (CF) has one surface of the support coated with a color acceptor. The middle sheet (CFB) has one surface of the support coated with color former-containing microcapsules and the other surface thereof coated with a color acceptor. There are also used pressure sensitive manifold papers of the self-contained type having one surface of the support covered with a laminate of, or a mixture of, color former-containing microcapsules and a color acceptor.

When the recording materials of this invention are used to prepare pressure sensitive manifold papers, any one or, when required, all of the PF compound and/or composite iron salt and ligand compound may be encapsulated. In encapsulation, the PF compound and/or composite iron salt or the ligand compound is contained in an organic solvent and encapsulated in the form of droplets. The organic solvent to be used for this purpose is preferably high in solubility and involatile or low in volatility. Given below are examples of useful organic solvents to which, however, they are not limited. These solvents are usable singly or in mixture. Examples thereof are cotton seed oil and like vegetable oils, kerosene, paraffin, naphthene oil, chlorinated paraffin and like mineral oils, alkylated biphenyl, alkylated terphenyl, alkylated naphthalene, diarylethane, triarylmethane, diphenylalkane and like aromatic hydrocarbons, oleyl alcohol, tridecyl alcohol, benzyl alcohol, 1-phenylethyl alcohol, glycerin and like alcohols, oleic acid and like organic acids, dimethyl phthalate, diethyl phthalate, di-n-butylphthalate, dioctyl phthalate, diethyl adipate, dipropyl adipate, di-n-butyl adipate, dioctyl adipate and like esters, tricresyl phosphate, tributyl phosphate, tributyl phosphite, tributyl phosphine oxide and like organic phosphorus compounds, phenyl cellosolve, benzylcarbitol, polypropylene glycol, propylene glycol monophenyl ether and like ethers, trioctylamine, stearyldimethylamine, dilaurylamine, α-ethylhexylamine and like amines, N,N-dimethyllaurylamide, N,N-dimethylstearylamide, N,N-dihexyloctylamide and like amides, diisobutyl ketone, methylhexylketone and like ketones, ethylene carbonate, propylene carbonate and like alkylene carbanates, etc.

The oily droplets of the PF compound and/or composite iron salt or ligand compound can be encapsulated by any of known processes such as coacervation process, interfacial polymerization process, in-situ polymerization process, etc. Preferable of these conventional processes are those disclosed in Japanese Examined Patent Publication No. 16949/1979 and Japanese Unexamined Patent Publication No. 84881/1978 in which urea formaldehyde resin and melamine formaldehyde resin are used as the wall-forming material. The microcapsules thus obtained are mixed, when required, with auxiliaries usually used in the art to which this invention pertains, whereby a capsule coating composition is prepared. Typical of useful auxiliaries are water-soluble or latex type binder, capsule-protecting agent, talc, calcined kaolin, calcium carbonate and like pigments, dispersing agent, antifoaming agent, antiseptic, fluorescent white dye, etc. Useful water-soluble binders include gelatin, albumin, casein and like proteins, corn starch, α-starch, oxidized starch, etherified starch, esterified starch and like starches, carboxymethyl cellulose, hydroxyethyl cellulose and like celluloses, water-soluble natural high molecular weight compounds such as agar, sodium aliginate, gum arabic and like saccharoses, polyvinyl alcohol, polyvinyl pyrrolidone, polyacrylic acid, polyacrylamide, maleic acid copolymer and like water-soluble synthetic high molecular weight compounds, etc. Examples of useful latex binders are styrene-butadiene latex, acrylonitrile-butadiene latex, acrylic ester latex, vinyl acetate latex, methyl methacrylate-butadiene latex and carboxy-modified (e.g. acrylic acid) latex, etc. Examples of useful capsule-protecting agents are cellulose powder, starch granules, etc. The amounts of the binder and capsule-protecting agent to be used are not particularly limited.

The ligand compound or the PF compound and/or composite iron salt, when not encapsulated, is pulverized as required by a ball mill, attritor, sand mill, etc. and mixed with auxiliaries usually used such as white pigment, binder, dispersing agent, colored dye, fluorescent white dye, ultraviolet ray absorbing agent, antioxidant, acid or like stabilizers, etc. to prepare a coating composition. It is preferred to pulverize the ligand compound or the PF compound and/or composite iron salt by using water. Dispersing agents useful for wet pulverization and also for preparing coating compositions include low molecular weight and high molecular weight dispersing agents and surfactants. Examples thereof are sodium alkylsulfate, sodium alkylbenzenesulfonate, sodium alkylnaphthalenesulfonate, sodium polystyrenesulfonate, sodium oleic acid amide sulfonate, sodium dialkylsulfosuccinate, sulfonated castor oil, and like anionic surfactants, trimethylaminoethylalkylamide halide, alkyl pyridinium sulfate, alkyl trimethyl ammonium halide and like cationic surfactants, polyoxyethylenealkyl ether, polyoxyethylene fatty acid ester, polyoxyethylene polyhydric alcohol ester of fatty acid, cane sugar ester of fatty acid and like nonionic surfactants, alkyl trimethylaminoacetic acid, alkyl diethylenetriaminoacetic acid and like amphoteric surfactants, starch, phosphated starch, polyvinyl alcohol, carboxymethyl cellulose, sodium alginate, sodium polyacrylate, sodium salt of vinyl acetate-maleic anhydride copolymer, ammonium salt of styrene-maleic anhydride copolymer, sodium salt of butadiene-methacrylate copolymer and like water-soluble high molecular weight compounds, etc. Examples of useful white pigments are oxide, hydroxide, carbonate, sulfate, phosphate, silicate and halogenated compounds of aluminum, zinc, magnesium, calcium and titanium, and silica, terra abla, activated clay, attapulgite, zeolite, bentonite, kaolin, calcined kaolin, talc and like clays, etc. Usable as the binder are those useful for preparation of the capsule coating composition. These binders are used singly or in mixture.

When pressure sensitive manifold papers are prepared by using the recording materials of this invention, the ligand compound is favorably encapsulated to improve the stability of the compound.

The coating composition thus prepared for recording materials is applied to substrates in the conventional manner to produce pressure sensitive manifold papers.

In preparing heat sensitive recording papers or electrothermal recording papers by using the recording materials of this invention, a coating composition can be prepared by the known process, employing the ligand compound and the PF compound and/or composite iron salt of this invention in place of the conventional color former and color acceptor, together with auxiliaries known in the field.

When producing heat sensitive recording papers, finely divided particles of each of the ligand compound and the PF compound and/or composite iron salt are dispersed in a medium having a binder dissolved or dispersed therein to obtain a dispersion. The two dispersions thus prepared are mixed together to produce a coating composition which is then applied to a support of the paper. Alternatively the two dispersions are made into two coating compositions which are then applied in two layers to a support of the paper, whereby heat sensitive recording papers are obtained.

The binder to be used for preparing the coating composition is suitably selected from starches, hydroxypropyl cellulose and like celluloses, proteins, gum arabic, polyvinyl alcohol, salt of styrene-maleic anhydride copolymer, emulsion of styrene-butadiene copolymer, salt of vinyl acetate-maleic anhydride copolymer, polyacrylate, etc. In order to improve the color forming ability, delustering, writing properties and the coloring of the coating composition, when required, the coating composition may have incorporated therein oxide, hydroxide and carbonate of polyvalent metal and like inorganic metal compounds, inorganic pigment, dispersing agent, ultraviolet ray absorbing agent, thermally melting agent, antifoaming agent, fluorescent dye, colored dye, EDTA and like amino calboxylic acid compounds, etc.

Electrothermal recording papers are prepared by applying to a support of the paper a coating composition having dispersed therein the PF compound and/or composite iron salt, the ligand compound, an electroconductive material and a binder or by applying such coating composition excluding the electroconductive material to an electroconductive support of the paper which is prepared by covering the support with an electroconductive material. When the ligand compound and the PF compound and/or composite iron salt are unable to melt at a preferable temperature of 70° to 120° C., it is possible to adjust the sensitivity to Joule's heat by using an adequate thermally melting agent.

When pressure sensitive manifold papers, heat sensitive recording papers or electrothermal recording papers are prepared, the coating composition is applied by an air knife coater, roll coater, blade coater, size press coater, curtain coater, bill blade coater or the like to a suitable substrate such as paper, synthetic fiber paper, synthetic resin film or the like. The coating may be formed by printing on the substrate aqueous or solvent type flexographic ink, letterpress ink, lithographic ink, UV ink, EB ink or the like into which at least one of the ligand compound, PF compound and composite iron salt is formulated.

The recording materials of this invention can be used conjointly with other chelate type, leuco type or like recording materials in order to improve the color forming ability of the recording sheets.

According to this invention, the recording materials, namely the ligand compound and the PF compound and/or composite iron salt, are employed in an amount of usually about 0.2 to about 10 g/m$^2$, preferably about 0.2 to about 6 g/m$^2$, although the amount varies with the kind of the materials, the content of a coating composition and a specific purpose.

This invention will be described below in more detail with reference to Examples and Comparison Examples in which parts and percentages are all by weight, unless specially indicated.

Examples 1 to 26 and Comparison Examples 1 to 6 exemplify the preparation of pressure sensitive manifold papers. Examples 27 to 30 describe the preparation of heat sensitive recording papers and Example 31 indicates the production of electrothermal recording papers.

EXAMPLE 1

Preparation of an under sheet

To 800 parts of 5% aqueous solution of sodium hydroxide was added 250 parts of diphenyl phosphate. An aqueous solution of 90 parts of ferric chloride ($FeCl_3 6H_2O$) in 500 parts of water was added to the solution with stirring to precipitate iron salt of diphenyl phosphate. The precipitate was filtered off and was washed with water and dried to obtain a light yellow fine powder.

In 250 parts of water were dissolved 1 part of sodium polystyrenesulfonate and 1 part of polyvinyl alcohol as dispersing agents. Thereto were added 20 parts of the fine powder, 30 parts of zine oxide, 30 parts of aluminum hydroxide and 20 parts of calcium carbonate. The mixture was pulverized by a sand mill. To the resulting dispersion was added 15 parts of styrene-butadiene copolymer latex (50% concentration) to prepare a coating composition.

The coating composition was applied by a blade coater to a paper substrate weighing 40 g/m$^2$ in an amount of 5 g/m$^2$ by dry weight to obtain a virtually colorless under sheet.

The whiteness of the coated surface of the under sheet was 78% when measured by an electric reflectance photometer (trade name "ELREPHO", product of Carl-Zeiss using a filter of No. 8 grade).

Preparation of a microcapsule dispersion containing a ligand compound and a top sheet A 20 part quantity of lauryl gallate was dissolved with heating in a mixture of 80 parts of di-n-butyl adipate and 20 parts of diethyladipate to obtain an oil. A 20% aqueous solution of sodium hydroxide was added to a mixture of 210 parts of an aqueous solution containing urea (10 parts) and resorcin (1 part) with 100 parts of 10% aqueous solution of ethylene-maleic anhydride copolymer to prepare an aqueous solution having a pH of 3.5. To the solution was added the oil and emulsified to obtain a dispersion of particles 5$\mu$ in average size. Thereto was added 25 parts of 37% aqueous solution of formaldehyde. Thereafter the system was adjusted to a temperature of 70° C. and stirred for 4 hours to prepare a microcapsule dispersion.

A 20 part quantity of wheat starch powder and 10 parts of pulp powder were added to the dispersion. Water was added thereto in such amount as to achieve 25% solids concentration, whereby a capsule-containing coating composition was obtained. The coating composition was applied by an air-knife coater to a paper substrate weighing 40 g/m$^2$ in an amount of 5 g/m$^2$ (calculated as solids) to prepare a top sheet.

The top sheet was superposed on the under sheet with the coatings facing each other and images were formed on the under sheet by typewriting. The color density of the images upon typewriting (hereinafter referred to as "initial color density") and that with a lapse of one day (hereinafter referred to as "final color density") were measured in terms of absorbance at a wavelength of 570 mμ by a spectrophotometer (trade name "UVIDEC-505", product of Japan Spectroscopic Co., Ltd.). As a result, images were found to exhibit sharpness with a final color density of as high as 0.58 although with an initial color density of as low as 0.2.

The images thus formed were exposed to sunlight for 1 hour to evaluate the light resistance of the images with the unaided eye and were found to undergo little or no change in color density.

EXAMPLE 2

Preparation of an under sheet

A 1200 part quantity of 5% aqueous solution of sodium hydroxide was added 188 parts of diphenyl phosphate and 134 parts of 4-tert-butylbenzoic acid. To the solution was added an aqueous solution of 135 parts of ferric chloride in 1000 parts of water with stirring to precipitate a mixture of composite iron salts comprising diphenyl phosphate and 4-tert-butylbenzoic acid. The precipitate was filtered off and was washed with water and dried to obtain a light yellow fine powder.

A 17.3 part quantity of the fine powder, 30 parts of zinc oxide, 30 parts of aluminum hydroxide and 20 parts of calcium carbonate were added to 250 parts of water having dissolved therein 1 part of sodium alkylnaphthalenesulfonate and 1 part of polyvinyl alcohol. The mixture was pulverized by a sand mill. To the dispersion was added 15 parts of styrene-butadiene copolymer latex (50% concentration) to prepare a coating composition.

The coating composition was applied by an air knife coater to a paper substrate weighing 40 g/m$^2$ in an amount of 5 g/m$^2$ by dry weight to obtain a substantially colorless under sheet. The whiteness of the under sheet was 75% when measured in the same manner as in Example 1.

A top sheet prepared in the same manner as Example 1 was superposed on the under sheet thus obtained with the coatings facing each other. Then images were formed on the under sheet by typewriting. The color density of the images were measured in the same manner as in Example 1. The images were found to have sharpness with an initial color density of 0.55 and a final color density of 0.65. The light resistance of the images was evaluated in the same manner as in Example 1 and the images were recognized to have little or no variation in color density.

EXAMPLE 3

Preparation of an under sheet

To 1200 parts of 5% aqueous solution of sodium hydroxide was added 250 parts of diphenyl phosphate and 86 parts of 1-naphthoic acid. An aqueous solution of 135 parts of ferric chloride in 1000 parts of water was mixed with the solution to precipitate a mixture of composite iron salts comprising diphenyl phosphate and 1-naphthoic acid. The precipitate was filtered off and was washed with water to obtain a light yellow slurry.

To a solution of 1 part of sodium polystyrenesulfonate and 1 part of polyvinyl alcohol in 250 parts of water was added 20 parts (calculated as solids) of the slurry, 30 parts of titanium oxide, 45 parts of aluminum hydroxide and 5 parts of activated clay. The mixture was pulverized by a sand mill. To the dispersion was added 15 parts of styrene-butadiene copolymer latex (50% concentration) to prepare a coating composition.

The coating composition was applied by a rod blade coater to a paper substrate weighing 40 g/m$^2$ in an amount of 5 g/m$^2$ by dry weight, whereby an under sheet was prepared. The whiteness of the under sheet was 76.3% when measured in the same manner as in Example 1.

Preparation of ligand compound-containing microcapsules and middle sheets

A 15 part quantity of lauryl gallate and 5 parts of isoamyl gallate were dissolved in a mixture of 70 parts of diethyl adipate and 30 parts of oleyl alcohol with heating to prepare an oil. The oil was added to 100 parts of 5% aqueous solution having a pH of 5 and containing SCRIPSET 520 (trade name of styrene-maleic anhydride copolymer, product of Monsant Co.) and a small amount of sodium hydroxide, and emulsified to obtain a dispersion of particles 4.0μ in average size. Ten parts of melamine and 25 parts of 37% aqueous solution of formaldehyde were added to 65 parts of water. The mixture was adjusted to a pH of 9 with sodium hydroxide and heated to 80° C. for 15 minutes, whereby a melamine-formaldehyde initial condensate was obtained. The dispersion was added to the condensate and the mixture was stirred for 1 hour at 75° C. to prepare a microcapsule dispersion.

The dispersion was mixed with 30 parts of wheat starch powder and 10 parts of pulp powder. Water was added to the mixture in such amount as to achieve 25% solids concentration to prepare a capsule-containing coating composition. The coating composition was applied by an air knife coater to the reverse side of the under sheet coated with the composite iron salt coating composition in an amount of 5 g/m$^2$ by dry weight to prepare middle sheets.

Two middle sheets thus obtained were superposed on each other and images were formed by typewriting. Clear images were recorded on the virtually colorless sheet with an initial color density of 0.50 and a final color density of 0.63.

The images were marked with line markers (trade name "LION APPEAL MARKER", red, green and yellow markers, products of Fukui Co., Ltd.). The images were found to exhibit little or no change in color density.

COMPARISON EXAMPLE 1

To 1200 parts of 5% aqueous solution of sodium hydroxide was added 267 parts of 4-tert-butylbenzoic acid. An aqueous solution of 135 parts of ferric chloride in 1000 parts of water was added to the solution with stirring to precipitate iron salt of 4-tert-butylbenzoic acid. The precipitate was filtered off and was washed with water and dried to obtain a brown fine powder.

An under sheet was prepared in the same manner as in Example 1 with the exception of using 14.6 parts of the fine powder. The under sheet was found to have brown color, hence poor in commercial value. The whiteness of the under sheet was 65.8% when measured in the same manner as in Example 1.

A top sheet prepared in the same manner as Example 1 was superposed on the under sheet, and images were formed on the under sheet by typewriting. When measured in the same manner as in Example 1, the initial color density was 0.53 and the final color density was 0.65.

The light resistance of the images was evaluated in the same manner as in Example 1 with the result similar to that obtained in Example 1.

COMPARISON EXAMPLE 2

An under sheet was prepared in the same manner as in Comparison Example 1 with the exception of using 4.8 parts of the fine powder of iron salt used therein. The under sheet when evaluated in the same manner as in Example 1 was found to have a whiteness of as high as 75% but a final color density of as low as 0.30, far poorer than those in Example 1 and 2.

COMPARISON EXAMPLE 3

The same procedure as in Example 3 was repeated with the exception of using only 258 parts of 1-naphthoic acid in place of the 250 parts of diphenyl phosphate and 86 parts of 1-naphthoic acid used in Example 3, producing a reddish brown slurry of iron salt of 1-naphthoic acid. An under sheet was prepared in the same manner as in Example 3 with the exception of using 15.7 parts of the slurry (calculated as solids) and was found to have reddish brown color, hence low in commercial value. The whiteness of the under sheet was 66.3%. The final color density was 0.63 when measured in the same manner as in Example 1 by using a top sheet prepared in a similar manner.

EXAMPLE 4

To 2400 parts of 5% aqueous solution of sodium hydroxide were added 192 parts of 4-n-pentyl-benzoic acid and 158 parts of phenyl phosphonic acid. To the solution was added an aqueous solution of 270 parts of ferric chloride in 1000 parts of water with stirring to precipitate a mixture of composite iron salts of phenylphosphonic acid and 4-n-pentyl-benzoic acid. The precipitate was filtered off and washed with water and dried, giving a light yellow fine powder. An under sheet was prepared in the same manner as in Example 1 with the exception of using 10 parts of the fine powder.

The whiteness of the under sheet was 74.8% when measured in the same manner as in Example 1. A top sheet prepared in the same manner as in Example 1 was superposed on the under sheet to form images on the under sheet by typewriting. The images were found to have a good initial color density and a final color density of 0.64 and a high light resistance, hence excellent.

COMPARISON EXAMPLE 4

To 2400 parts of 5% aqueous solution of sodium hydroxide was added 576 parts of 4-n-pentyl-benzoic acid. An aqueous solution of 270 parts of ferric chloride in 1000 parts of water was added to the solution with stirring to precipitate iron salt of 4-n-pentyl-benzoic acid. The precipitate was filtered off and washed with water and dried to produce a brown fine powder. An under sheet was prepared in the same manner as in Example 1 with the exception of using 15.7 parts of the fine powder and was found to have brown color and a whiteness of 63.5%, hence poor in commercial value. The final color density was 0.62 when measured in the same manner as in Example 1 using a top sheet prepared in a similar manner.

EXAMPLES 5 AND 6

The procedure of Example 3 was repeated with the exception of using 234 parts of diphenyl phosphite and 61 parts of benzoic acid, 322 parts of di-n-octyl phosphate and 69 parts of thiobenzoic acid respectively in place of the diphenyl phosphate and 1-naphthoic acid used in Example 3, producing two kinds of mixtures of composite iron salts in the form of light yellow fine powders.

Two types of under sheets were prepared in the same manner as in Example 3 with the exception of using 17.7 parts and 23 parts respectively of the two kinds of fine powders. The whiteness of these under sheets were 76% and 75.3% respectively.

The sheets were 0.62 and 0.63 respectively in final color density as measured in the same manner as in Example 1 using top sheets prepared in like manner.

COMPARISON EXAMPLES 5 AND 6

The procedure of Example 3 was repeated with the exception of using 183 parts of benzoic acid and 207 parts of thiobenzoic acid respectively in place of the diphenyl phosphate and 1-naphthoic acid used in Example 3, producing two kinds of iron salts respectively in the form of reddish brown powder and brown fine powder.

Two types of under sheets were prepared in the same manner as Example 3 with the exception of using 11.6 parts and 12.9 parts respectively of the two kinds of fine powders. The two types of sheets thus prepared were found to have reddish brown color and brown color respectively and to be unsuitable for practical use with whiteness of 64.5% and 67.3% respectively.

The sheets were 0.64 and 0.62 respectively in final color density as measured in the same manner as in Example 1 using top sheets prepared in like manner.

EXAMPLE 7

Preparation of an under sheet

The procedure of Example 3 was repeated with the exception of using 314 parts of diphenyl thiophosphate and 89 parts of 4-tert-butylbenzoic acid in place of the diphenyl phosphate and 1-naphthoic acid employed in Example 3, producing an under sheet. The under sheet thus obtained was found to have a whiteness of 75.3%.

Preparation of ligand compound-containing microcapsules and a top sheet

A 15 part quantity of lauryl gallate and 5 parts of lauryl-8-hydroxyquinoline were dissolved in a mixture of 50 parts of di-n-butylphthalate and 50 parts of diethyl adipate with heating to obtain an oil. The oil was added to 200 parts of 10% aqueous solution of acid-treated gelatin having an isoelectric point of 8.0 and the mixture was treated by a homogenizer to obtain an emulsion containing particles 5.0$\mu$ in average size. To the emulsion was added 500 parts of 0.5% aqueous solution of carboxymethyl cellulose (average polymerization degree of 160 and substitution degree of 0.6) having a temperature of 50° C. The system was adjusted to a pH of 5 with 5% aqueous solution of sodium hydroxide and vigorously stirred until the system was cooled to 10° C. Thereafter 3 parts of 50% aqueous solution of glutaraldehyde was added to the system and the mixture was adjusted to a pH of 7.0 with 5% aqueous solution of sodium hydroxide. Then the mixture was stirred for 5 hours to complete curing of the capsules.

To the capsule dispersion were added 20 parts of wheat starch powder and 20 parts of pulp powder to prepare a capsule-containing coating composition. The coating composition was applied by an air knife coater to a paper substrate weighing 40 g/m$^2$ in an amount of 5 g/m$^2$ by dry weight.

The top sheet was superposed on the under sheet and images were formed on the under sheet by typewriting. The images were found to be clear with a good initial color density and a final color density of 0.64 and to be outstanding in light resistance, exhibiting little or no variation in color density after they were marked by line markers.

EXAMPLE 8

The procedure of Example 1 was repeated with the exception of employing 31.3 parts of iron salt prepared by using 402 parts of di(p-biphenylyl)phosphate in place of diphenyl phosphate used in Example 1, thereby producing an under sheet.

The under sheet thus obtained was found to have a whiteness of 77%, and was similar in color density (final color density of 0.58) when evaluated by use of a top sheet prepared in the same manner as in Example 1.

EXAMPLES 9 TO 19

The procedure of Example 2 was repeated with the exception of using organic phosphorus compounds and carboxylic acids as shown in Table I given below respectively in an amount of parts indicated therein, thereby producing 11 kinds of mixtures of composite iron salts in the form of a light yellow fine powder.

Eleven kinds of under sheets were prepared in the same manner as in Example 2 with the exception of using the fine powders respectively in an amount of parts indicated therein. The whiteness of the under sheets was measured in the same manner as in Example 1. Top sheets prepared in the same manner as in Example 1 were superposed on the under sheets to evaluate the final color density in the same manner with the results tabulated in Table I.

TABLE I

| Example No. | Organic phosphorus compound Formula | X | R | Carboxylic acid | A/B* (parts by weight) | Mixture of composite iron salts (parts by weight) | White-ness | Final color density |
|---|---|---|---|---|---|---|---|---|
| 9 | R<br>\|<br>R—P—XH | O** | Phenyl | (a) | 202/178 | 623 | 75.2 | 0.63 |
| 10 | X<br>‖<br>R—P—H<br>\|<br>XH | O | 2-(2'-hydroxy phenyl)-phenyl | (b) | 234/234 | 755 | 76.4 | 0.65 |
| 11 | X<br>‖<br>R—P—XH<br>\|<br>XH | O | Phenyl | (c) | 158/192 | 403 | 77.3 | 0.62 |
| 12 | X<br>‖<br>RX—P—XH<br>\|<br>XH | O | Phenyl | (a) | 174/178 | 405 | 77.2 | 0.63 |
| 13 | X<br>‖<br>RX—P—XH<br>\|<br>XR | O | 4-methylphenyl | (a) | 278/178 | 737 | 77.2 | 0.61 |
| 14 | X<br>‖<br>RX—P—XH<br>\|<br>XR | O | 4-chlorophenyl | (a) | 319/178 | 799 | 76.5 | 0.64 |
| 15 | X<br>‖<br>R—P—XH<br>\|<br>XR | O | Phenyl | (a) | 234/178 | 671 | 76.0 | 0.63 |
| 16 | X<br>‖<br>R—P—XH<br>\|<br>R | O | Phenyl | (a) | 218/178 | 647 | 76.3 | 0.62 |

TABLE I-continued

| Example No. | Organic phosphorus compound Formula | X | R | Carboxylic acid | A/B* (parts by weight) | Mixture of composite iron salts (parts by weight) | White-ness | Final color density |
|---|---|---|---|---|---|---|---|---|
| 17 | 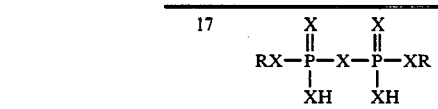 | O | Phenyl | (a) | 330/178 | 561 | 74.5 | 0.64 |
| 18 | 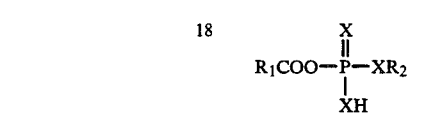 | O | $R_1$ = Propyl<br>$R_2$ = Phenyl | (a) | 244/178 | 686 | 77.5 | 0.61 |
| 19 | 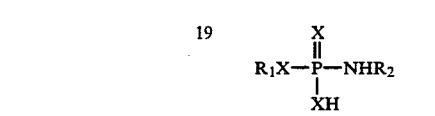 | O | $R_1$ = Phenyl<br>$R_2$ = Benzyl | (a) | 263/178 | 715 | 76.5 | 0.63 |

*A = Organic phosphorus compound, B = Carboxylic acid,
**O = Oxygen
(a) = 4-tert-butyl-benzoic acid,
(b) = 4-n-octyl-benzoic acid,
(c) = 4-n-pentyl-benzoic acid.

EXAMPLE 20

An under sheet was prepared by repeating the procedure of Example 2 with the exception of using 16.6 parts of light yellow fine powder of a mixture of composite iron salts prepared in the same manner as in Example 2 employing 174 parts of 3,4,5,6-dibenzo-1,2-oxaphosphane-1-hydroxy-2-oxide in place of diphenyl phosphate employed in Example 2.

The whiteness of the under sheet was 76.2%. The final color density was 0.63 when measured in the same manner as in Example 1 by using a top sheet prepared in a similar manner.

EXAMPLE 21

To 1200 parts of 7% aqueous solution of potassium hydroxide were added 125 parts of diphenyl phosphate, 79 parts of phenyl phosphonic acid and 89 parts of 4-tert-butylbenzoic acid. To the solution was added an aqueous solution of 216 parts of ferric chloride in 1000 parts of water with stirring, producing a precipitate of a mixture of composite iron salts. The precipitate was filtered off and was washed with water and dried to afford a light yellow fine powder.

An under sheet was prepared in the same manner as in Example 2 with the exception of using 13.9 parts of the fine powder.

The under sheet was 76.2% in whiteness. A top sheet prepared in the same manner as in Example 1 was superposed on the under sheet to record images by typewriting. The images were clear, the final color density being 0.63.

EXAMPLE 22

In 2000 parts of water were dispersed 188 parts of diphenyl phosphate, 89 parts of 4-tert-butylbenzoic acid and 87 parts of sodium laurylbenzene sulfonate. To the dispersion was added 10% aqueous solution of sodium hydroxide with stirring to achieve a pH of 8. Thereto was added an aqueous solution of 135 parts of ferric chloride in 1000 parts of water to precipitate a mixture of composite iron salts. The precipitate was filtered off and was washed with water and dried, giving a light yellow fine powder.

An under sheet was prepared in the same manner as in Example 2 with the exception of using 17.3 parts of the fine powder.

The under sheet was 75.0% in whiteness. A top sheet in the same manner as in Example 1 was superposed on the under sheet and images were formed by typewriting with sharpness, the final color density being 0.64.

EXAMPLE 23

The procedure of Example 1 was repeated except that there was used 73 parts of 2-carboxy-phenyl phosphate in place of diphenyl phosphate used in Example 1, whereby an under sheet was obtained which was found to have a whiteness of 74%.

A top sheet prepared in the same manner as in Example 1 was superposed on the under sheet and images were formed with such clearness as to achieve a final color density of 0.64.

EXAMPLE 24

A 133 part quantity of di(2,4-di-α-methylbenzylphenyl)phosphate was dissolved in 500 parts of benzene. To the solution was added 500 parts of aqueous solution containing 8 parts of sodium hydroxide with vigorous agitation to obtain sodium organic phosphate. Thereto was added 500 parts of aqueous solution containing 18 parts of ferric chloride with vigorous agitation. The liquid was repeatedly separated and washed with water by a separating funnel and was dried over anhydrous sodium sulfate. The benzene was distilled off and a light yellow oil was obtained. The oil (10 parts) was dissolved in 20 parts of benzene. The solution was applied in an amount of 1 $g/m^2$ (calculated as solids) to a paper substrate weighing 45 $g/m^2$ and precoated with zinc oxide in an amount of 5 $g/m^2$ (calculated as solids), whereby an under sheet was prepared.

A top sheet prepared in the same manner as in Example 1 was superposed on the under sheet. Typewriting produced sharp images with a final color density of 0.5 although with a slightly poor initial color density involved.

EXAMPLE 25

Preparation of iron compound-containing microcapsules and a top sheet

A 133 part quantity of di(2,4-di-α-methylbenzylphenyl)phosphate and 17.8 parts of 4-tert-butylbenzoic acid were dissolved in 1000 parts of benzene. To the solution was added 500 parts of an aqueous solution containing 12 parts of sodium hydroxide with stirring to obtain sodium salt. Thereto was added 500 parts of an aqueous solution containing 27 parts of ferric chloride and the mixture was thoroughly stirred. The liquid was repeatedly separated and washed with water by a separating funnel and was dried over anhydrous sodium sulfate. The benzene was distilled off and a light yellow oil was obtained.

Twenty parts of the iron compound thus obtained was dissolved in 100 parts of diethyl adipate to prepare an oil. 210 parts of aqueous solution containing 10 parts of urea and 1 part of resorcin was mixed with 100 parts of 10% aqueous solution of ethylene-maleic anhydride copolymer. The mixture was adjusted to a pH of 3.5 with 20% aqueous solution of sodium hydroxide. Thereto was added the oil, and the mixture was treated by a homogenizer to obtain an emulsion containing particles 5.0μ in average size. To the emulsion was added 25 parts of 37% aqueous solution of formaldehyde and the mixture was adjusted to a temperature of 70° C. and stirred for 4 hours to prepare a microcapsule dispersion.

To the dispersion were added 20 parts of wheat strarch powder and 10 parts of pulp powder to prepare a capsule-containing coating composition. The coating composition was applied by an air knife coater to a paper substrate weighing 40 g/m$^2$ in an amount of 5 g/m$^2$ by dry weight.

Preparation of an under sheet by using a ligand compound

In 250 parts of water were dissolved 1 part of sodium polystyrene sulfonate and 1 part of polyvinyl alcohol. To the solution were added 20 parts of lauryl gallate, 30 parts of zinc oxide, 50 parts of aluminum hydroxide and 1 part of citric acid. The mixture was pulverized by a sand mill. Fifteen parts of styrene-butadiene copolymer latex (50% concentration) was added to the dispersion to obtain a coating composition.

The coating composition was applied by an air knife coater to a paper substrate weighing 40 g/m$^2$ in an amount of 5 g/m$^2$ by dry weight, whereby a colorless under sheet was prepared.

The top sheet prepared above was superposed on the under sheet thus obtained and images were formed on the under sheet by typewriting. The images were produced with sharpness achieving a final color density of 0.58. The images were exposed to sunlight for one day but exhibited little or no variation in color density which means that the sheet was high in light resistance.

EXAMPLE 26

A coating composition was prepared in the same manner as in Example 3 with the exception of using 28.5 parts of a fine powder prepared by employing 402 parts of di(biphenylyl)phosphate and 89 parts of 4-tert-butylbenzoic acid in place of diphenyl phosphate and 1-naphthoic acid. The coating composition was applied to the coated surface of a top sheet prepared in the same manner as in Example 1 in an amount of 5 g/m$^2$ by dry weight to obtain a pressure sensitive manifold paper of self-contained type. The sheet was found to have a whiteness of 78.0%. Images were formed by a typewriter without a ribbon, exhibiting sharpness with a final color density of 0.64.

EXAMPLE 27

Thirty parts of a fine powder of a mixture of composite iron salts prepared in the same manner as in Example 2 was dispersed in 120 parts of 3% aqueous solution of polyvinyl alcohol. The dispersion was pulverized by a sand mill. Thirty parts of lauryl gallate and 2 parts of ethylenediaminetetraacetic acid (EDTA) were dispersed in 120 parts of 3% aqueous solution of polyvinyl alcohol. The dispersion was pulverized by a sand mill. The two dispersions were mixed together. Thereto were added 40 parts of aluminum hydroxide and 15 parts of styrene-butadiene copolymer latex (50% solids concentration) to prepare a coating composition for heat sensitive recording paper.

The coating composition was applied by an air knife coater to a paper substrate weighing 40 g/m$^2$ in an amount of 7 g/m$^2$ by dry weight to prepare a heat sensitive recording paper.

Clear images having a final color density of 0.60 were formed on the paper by a heated pen.

EXAMPLE 28

Five parts of iron salt of diphenyl phosphate prepared in the same manner as in Example 1 and 5 parts of titanium oxide were kneaded with 20 parts of varnish in a ball mill to prepare a paste. Aside from the above, 5 parts of gallic acid was kneaded with 15 parts of varnish in a ball mill to prepare a paste. The two pastes were mixed together to prepare ink.

A paper substrate was coated with the ink in an amount of 5 g/m$^2$ by a printing machine to prepare a heat sensitive recording paper. Distinct images having a final color density of 0.58 were formed by a heated pen.

EXAMPLE 29

The procedure of Example 2 was repeated except that there were used 452 parts of distearyl phosphate and 213 parts of stearic acid to prepare a fine powder of a mixture of composite iron salts. Thirty parts of the powder was dispersed in 120 parts of 3% aqueous solution of polyvinyl alcohol. The dispersion was pulverized by a sand mill. Aside from the above, 30 parts of lauryl gallate was dispersed in 120 parts of 3% aqueous solution of polvinyl alcohol and the dispersion was pulverized by a sand mill.

The two dispersions were mixed together. To the mixture were added 40 parts of talc, 5 parts of ethylenediaminetetraacetic acid (EDTA) and 15 parts of styrene-butadiene copolymer latex (solids concentration 50%) to prepare a coating composition for heat sensitive recording paper.

The coating composition was applied by an air knife coater to a paper substrate weighing 40 g/m$^2$ in an amount of 7 g/m$^2$ by dry weight to prepare a heat sensitive recording paper. Clear images having a final color density of 0.61 were formed on the paper by a heated pen.

EXAMPLE 30

There were dispersed in a ball mill 6 parts of a mixture of composite iron salts prepared in the same manner as in Example 29, 6 parts of hydroxypropyl cellulose, 50 parts of methanol, 16 parts of isopropyl alcohol and 20 parts of water to obtain a dispersion A. Aside from the above, dispersed in a ball mill were 8 parts of gallic acid, 1 part of EDTA, 6 parts of hydroxypropyl cellulose, 50 parts of methanol, 16 parts of isopropyl alcohol and 20 parts of water to obtain a dispersion B. The dispersions A and B were mixed together to prepare a coating composition for heat sensitive recording paper. The coating composition was applied to a paper substrate weighing 40 g/m$^2$ in an amount of 5 g/m$^2$ by dry weight to obtain heat sensitive recording paper. Sharp images having a final color density of 0.63 were formed on the paper by a heated pen.

EXAMPLE 31

To 200 parts of 1% aqueous solution of polyvinyl alcohol were added 200 parts of cuprous iodide and 5 parts of 10% aqueous solution of sodium sulfite. The mixture was pulverized by a sand mill until particles 2$\mu$ in average size were obtained. To the mixture were added 8 parts of polyacrylate emulsion and 20 parts of titanium oxide. The resulting mixture was fully dispersed and applied to a paper substrate weighing 50 g/m$^2$ in amount of 7 g/m$^2$ by dry weight. To the surface thus coated was applied a coating composition for heat sensitive recording paper prepared in the same manner as in Example 29 in an amount of 5 g/m$^2$ by dry weight, whereby a electrothermal recording paper was prepared. Clear images having a final color density of 0.62 were formed by a cylindrical scanning-type recording tester with a needle pressure of 10 g and a scanning speed of 630 mm/sec.

We claim:

1. In recording materials which comprise
a support
a metal compound, and
a ligand compound,
at least one of said compounds being provided on said support, said metal compound and said ligand compound being physically separated from one another and capable of forming a colored complex by chemical reaction between the metal compound and the ligand compound upon admixture thereof, the improvement wherein said metal compound comprises an organic phosphorous-iron compound having a bond of PO$^-$ and/or PS$^-$ with Fe$^{+++}$ in the molecule and said ligand compound is capable of reacting with the organic phosphorous-iron compound to form a complex.

2. Recording materials as defined in claim 1 in which one component of the organic phosphorus-iron compounds is at least one of organic phosphorus compounds represented by the following formulae (II) to (XIX) wherein the hydrogen of PO-H or PS-H is substituted with Fe$^{+++}$:

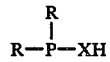
(II)

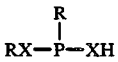
(III)

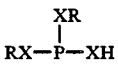
(IV)

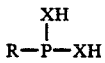
(V)

-continued

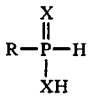
(VI)

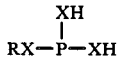
(VII)

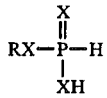
(VIII)

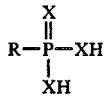
(IX)

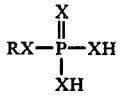
(X)

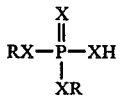
(XI)

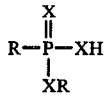
(XII)

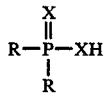
(XIII)

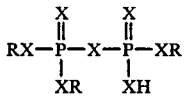
(XIV)

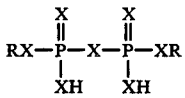
(XV)

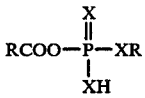
(XVI)

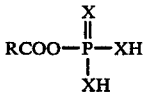
(XVII)

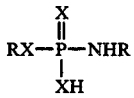
(XVIII)

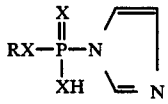
(XIX)

wherein X is the same or different and represents oxygen atom or sulfur atom and R is the same or different and represents alkyl group or aryl group.

3. Recording materials as defined in claim 2 in which the group represented by R in the formulae (II) to (XIX) is alkyl group or aryl group unsubstituted or having as a substituent halogen, cyano, hydroxyl, carboxyl, amino, sulfo, substituted or unsubstituted straight-chain or branched-chain alkyl or cycloalkyl, substituted or unsubstituted aryl, substituted or unsubstituted alkoxy, substituted or unsubstituted aryloxy, substituted or unsubstituted alkoxycarbonyl, substituted or unsubstituted aryloxycarbonyl, substituted or unsubstituted acyl or substituted or unsubstituted acylamino, said alkyl group or aryl group containing 4 to 20 carbon atoms except the carbon atoms in the substituent and 4 to 40 carbon atoms including those in the substituent.

4. Recording materials as defined in claim 2 in which the organic phosphorus-iron compound is a composite iron salt resulting from the reaction between at least one of the compounds of the formulae (II) to (XIX), a ferric salt and at least one of acids represented by the formula

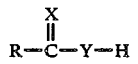

(I)

wherein R and X are as defined as above and Y represents oxygen atom or sulfur atom.

* * * * *